US005713054A

United States Patent [19]

Shimamura et al.

[11] Patent Number: 5,713,054

[45] Date of Patent: Jan. 27, 1998

[54] FILM CONTAINER HANDLING APPARATUS

[75] Inventors: Yasunobu Shimamura; Youji Nishimoto, both of Wakayama, Japan

[73] Assignee: Noritsu Koki Co., Ltd., Wakayama-Ken, Japan

[21] Appl. No.: 751,169

[22] Filed: Nov. 15, 1996

[30] Foreign Application Priority Data

Nov. 21, 1995 [JP] Japan ..... 7-302804

[51] Int. Cl.[6] ..... G03D 3/08

[52] U.S. Cl. ..... 396/612; 396/599

[58] Field of Search ..... 396/589, 594, 396/595, 599, 612, 615; 355/27–29; 414/411

[56] References Cited

U.S. PATENT DOCUMENTS

| | | | |
|---|---|---|---|
| 4,210,816 | 7/1980 | Stievenart et al. | 414/411 |
| 4,363,548 | 12/1982 | Oberhoffner et al. | 396/594 |
| 4,406,534 | 9/1983 | Viehrig et al. | 396/612 |
| 4,731,628 | 3/1988 | Uenaka et al. | 396/612 |
| 5,099,274 | 3/1992 | Mirlieb et al. | 355/27 |

FOREIGN PATENT DOCUMENTS

| | | |
|---|---|---|
| 2748480 | 5/1979 | Germany . |
| 3034085 | 3/1982 | Germany . |
| 3546199 | 7/1986 | Germany . |
| 3718131 | 12/1988 | Germany . |

*Primary Examiner*—D. Rutledge
*Attorney, Agent, or Firm*—Felfe & Lynch

[57] ABSTRACT

A film container handling apparatus for handling a film container (51) including a film entrance/exit opening (61) which is selectable between a first condition providing an opening and a second condition providing a larger opening. The apparatus includes a holding portion (12*a*) for holding the film container. The apparatus further includes opening levers (82) and a first cam member (87*a*) for switching over the film entrance/exit opening (61) of the film container (51) as held at the holding portion (12*a*) from the first condition to the second condition, and a discharging plate (92) and a second cam member (87*b*) for discharging the film container (51) from the film holding portion (12*a*) after the film (47*b*) has been removed from the film container (51) under the second condition.

13 Claims, 13 Drawing Sheets

FILM CONTAINER HANDLING APPARATUS

BACKGROUND OF THE INVENTION

1. Field of the Invention

The present invention relates to a film container handling apparatus for handling a film container including a film entrance/exit opening which is selectable between a first condition providing an opening and a second condition providing a larger opening. The invention more particularly relates to a film container handling apparatus of the above-noted type which is suitable for use with a film feeding device.

2. Description of the Related Art

A film feeding device is well-known which feeds a film to a developing section in order to subject this film to predetermined processes such as color development and fixation. Upon insertion of a patrone (an example of a 'film container') storing a 135 film therein, this feeding device is then capable of automatically feeding the inserted patrone to the developing section.

However, such automatic feeding capability of the above-described feeding device is limited to the 135 type film. Namely, in the case of a film of any other type, such as a 110 film or 126 film, the film needs first to be removed out of the film container and then charged into a film cartridge (another example of 'film container'). The above conventional film feeding device cannot automatically handle this cartridge. A significant portion of the feeding operation of this cartridge to the developing section depends on manual work by the operator. Further, there has not been known any handling apparatus which can automatically withdraw the film from the cartridge and then automatically feed this film to the developing section.

Therefore, there has been a demand for an improved film handling apparatus which can automatically feed various types of film to the developing section.

SUMMARY OF THE INVENTION

In view of the above, a primary object of the present invention is to provide a film container handling apparatus which can automatically feed a film to the developing section regardless of the type of the film.

A further object of the invention is to provide an appratus which allows automatic withdrawal of a film from a film container such as a cartridge.

For accomplishing the above object, according to the present invention, a film container handling apparatus for handling a film container including a film entrance/exit opening which is selectable between a first condition providing an opening and a second condition providing a larger opening, the apparatus comprising:

a holding portion for holding the film container;

opening means for switching over the film entrance/exit opening of the film container as held at the holding portion from the first condition to the second condition; and discharging means for discharging the film container from the film holding portion after the film has been removed from the film container under the second condition.

The film cartridge, which is one example of the film container handled by the invention's apparatus, is as specifically shown in FIGS. 11 through 17. This film cartridge has a film entrance/exit opening which is selectable between the first condition and the second condition. Under the second condition providing the opening of the greater area, the cartridge allows smooth removal of the film therefrom.

Then, according to the handling apparatus of the present invention, the switchover from the first condition to the second condition may be smoothly and automatically effected by the opening means. Further, after the removal of the film under the second condition, the empty cartridge may be automatically discharged from the holding portion by the discharging means. In sum, this apparatus may automatically carry out the series of operations including the opening of the film entrance/exit opening, removing of the film from the container, and the discharging of the empty container.

Further, if the holding portion is adapted for capable of holding also a film container storing the 135 type film, the apparatus may automatically effect the above operations for various types of films including the 135 type film.

According to one aspect of the invention, the apparatus further comprises detecting means for detecting holding of the film container at the holding portion, and the opening means is activated in response to an output signal from the detecting means.

With the above, since the opening means is activated after the film container has been held at the holding portion, the apparatus may handle the container with greater reliability.

Preferably, at least a portion of the holding portion is elastically deformable.

When the opening means acts on the film container, load is applied to e.g. a cover element of this container. Then, if the holding portion holding the film container is elastically deformable, the film container may be relieved from excessive load.

According to one embodiment thereof, the opening means includes a first drive cam and a first cam follower associated with the first drive cam for opening the film container.

With the above, the opening operation of the film container may be effected automatically by transmitting a drive force from a drive source to the first drive cam and the first cam follower.

According to one embodiment thereof, the discharging means includes a second drive cam and a second cam follower associated with the second drive cam for discharging the film container.

With the above, the discharging operation of the film container may be effected automatically by transmitting a drive force from a drive source to the second drive cam and the second cam follower.

Preferably, the first drive cam and the second drive cam are rotary cams which are mounted on a single common drive rotary shaft.

With the above, if the drive rotary shaft is driven by a single drive source, both the first drive cam and the second drive cam may be driven by the single drive source. As a result, the construction of the handling apparatus may be simple.

According to a further aspect of the invention, the drive source for the drive rotary shaft comprises a drive source of a film feeding device. The 'film feeding device' used herein refers generically to a device for automatically feeding a film to a developing section, a printing exposing section or the like. As the drive source, a motor may be generally employed.

With the above, it becomes unnecessary to provide an additional drive source dedicated to the handling apparatus. As the single drive source is shared by the feeding device and the handling apparatus, this film container handling apparatus may be used conveniently in combination with the film feeding apparatus.

Further and other objects, features and effects of the invention will become more apparent from the following more detailed description of the embodiments of the invention with reference to the accompanying drawings.

DETAILED DESCRIPTION OF THE PREFERRED EMBODIMENTS

Preferred embodiments of the present invention will now be described in details with reference to the accompanying drawings.

Figure 1:
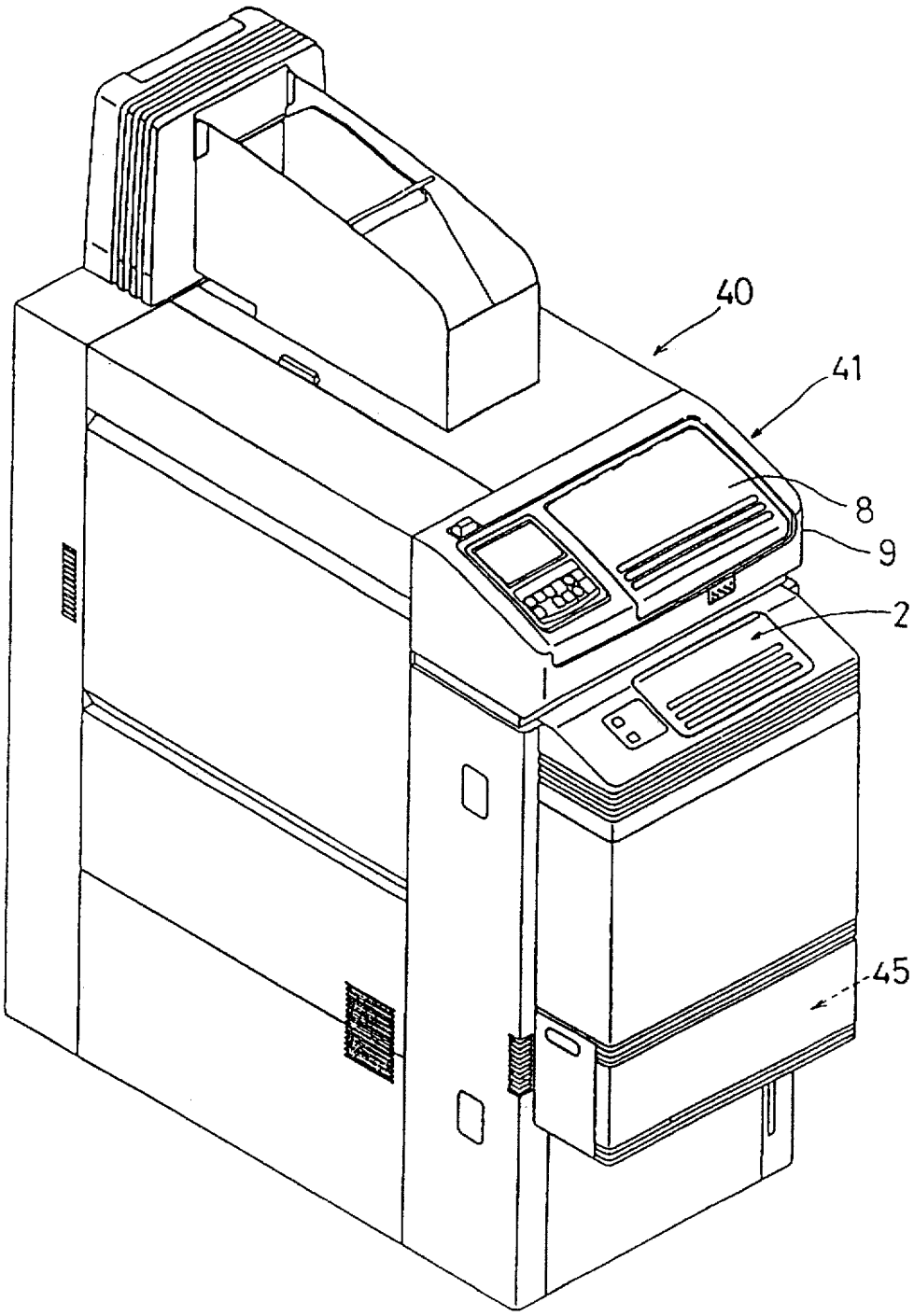
FIG. 1 is a perspective view of a film feeding device.
Figure 2:
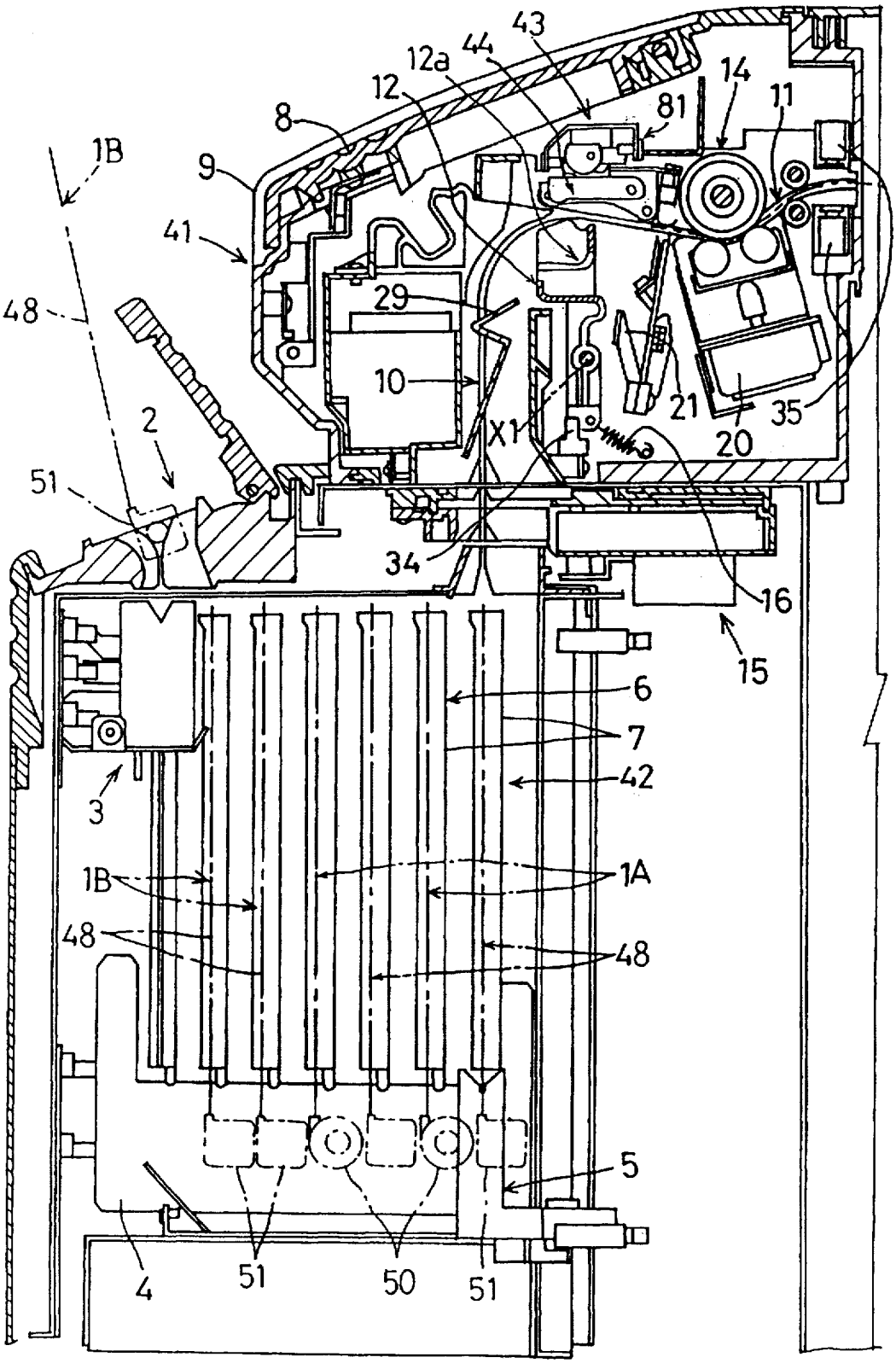
FIG. 2 is a side view showing the inside of the film feeding device.
Figure 3:
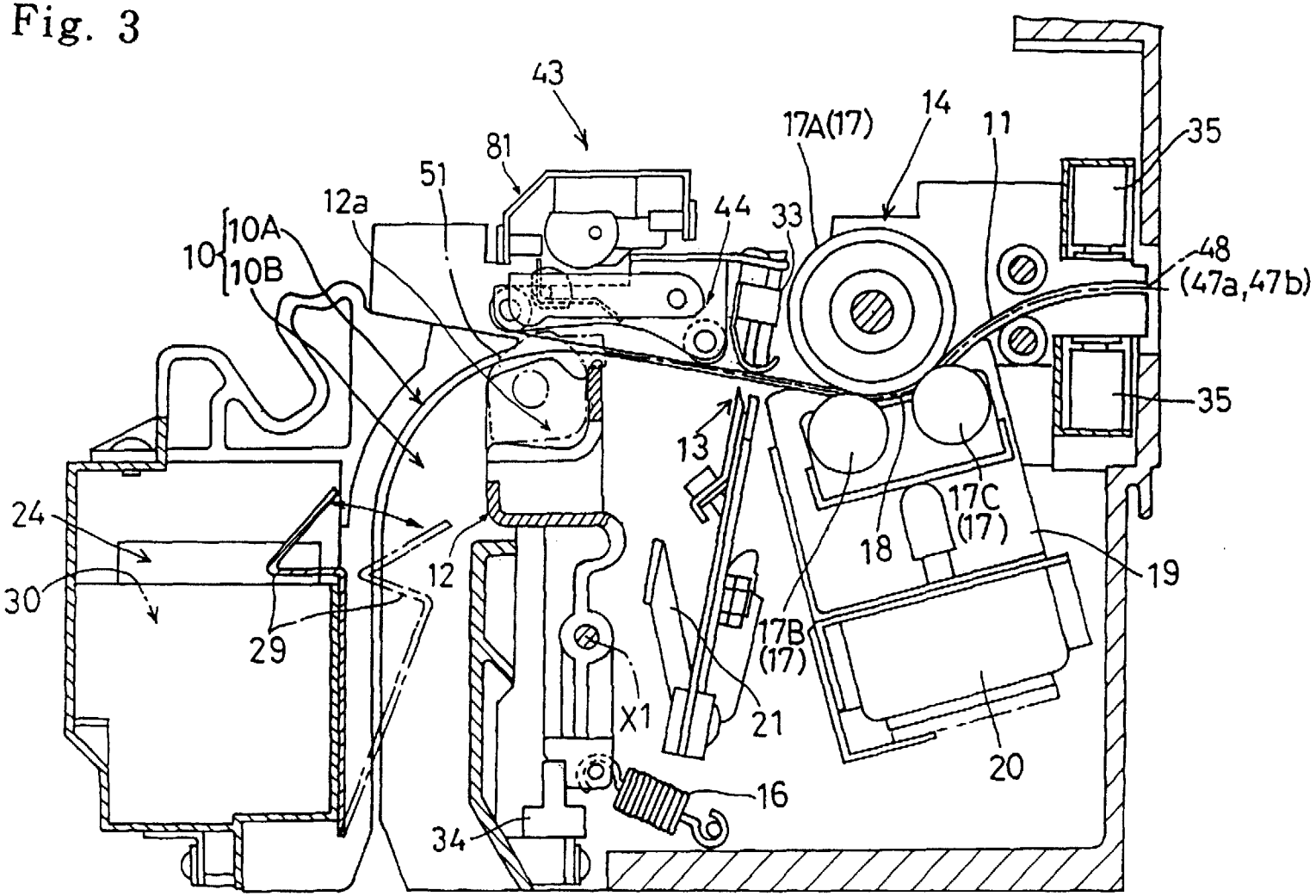
FIG. 3 is an enlarged side view showing principal portions of the inside of the film feeding device.

FIGS. 1 through 3 show a film feeding device 41 operable to withdraw a film 47*a*, 47*b* stored within either a film patrone 50 (an example of disposable type film container) or a film cartridge 51 (an example of reusable type film container) from the patrone or cartridge and then to feed the film to a developing section 40. This film feeding device 41 includes a film loading section 42 for loading a plurality of films 47*a*, 47*b* stored in the patrones 50 or cartridges 51 and a film feeding section 43 for feeding the films 47*a*, 47*b* charged one after another from the film loading section 42 to the developing section 40. The film feeding section 43 includes a separating section 44 for withdrawing the films 47*a*, 47*b* from the patrones 50 or cartridges 51 and then cutting the former off the latter. The feeding device 41 further includes a recovering section 46 for recovering the patrones 50 and the cartridges 51 from which the films 47*a*, 47*b* were cut at the separating section 44.

Each patrone 50 stores therein, in a rolled state, the film 47*a* having a width of about 35 mm, i.e. the film commonly referred to as the 135 film, with a trailing end of the film being affixed inside the patrone 50. Each cartridge 51 stores therein, in a rolled state, the film 47*b* having a width of about 24 mm, with the trailing end of the film being removable out of the cartridge 51 in association with the withdrawal of the film therefrom. The construction of the patrone 50 is well-known and therefore will not be described here.

Next, the construction of the cartridge 51 will be described in details with reference to FIGS. 11 through 17.

The cartridge 51 includes a pair of opposed side plates 52, 52, a bottom plate 53 attached to the lower ends of the side plates 52, 52, a front plate 55 formed integrally from the edge of the bottom plate 53 via an arcuate plate 54. Further, a guide plate 56 is formed integrally and upwardly from the upper edge of the front plate 55. The rear edge of the front plate 55 faces an edge of a cover 57. Pins 58 provided adjacent respective ends of the cover 57 are inserted and rotatably supported in pin holes 59 defined in the respective side plates 52.

Then, the cover 57 can be pivotably opened and closed about the pin holes 59. When the cover 57 is closed, a film entrance/exit opening 61 is defined. Upwardly and downwardly of this film entrance/exit opening 61, there are attached soft light shielding films 62, which come into gapless contact with each other to prevent intrusion of ambience light when the cover 57 is closed.

Figure 15:
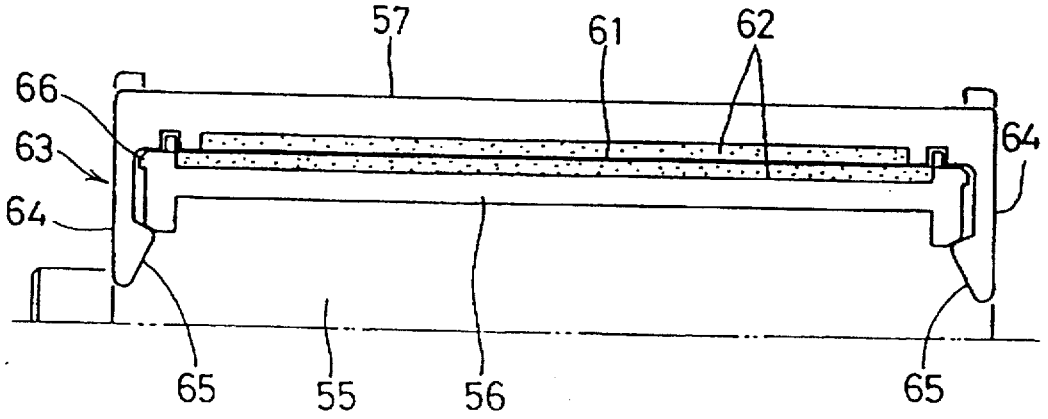
FIG. 15 is a view showing a film entrance/exit opening shown also in FIG. 12.

The cover 57 is retained at the closed state by means of a retaining mechanism 63. As shown in FIG. 15, the retaining mechanism 63 includes a pair of elastic engaging pawls 64 formed at the opposed ends of the opening/closing side of the cover 57. Each engaging pawl 64 includes a tapered face 65 at a leading end of the inner face thereof. As the respective engaging pawls 64 are caused to engage with the opposed ends of the lower side of the guide plate 56, the cover 57 is retained at the closed state.

Figure 16:
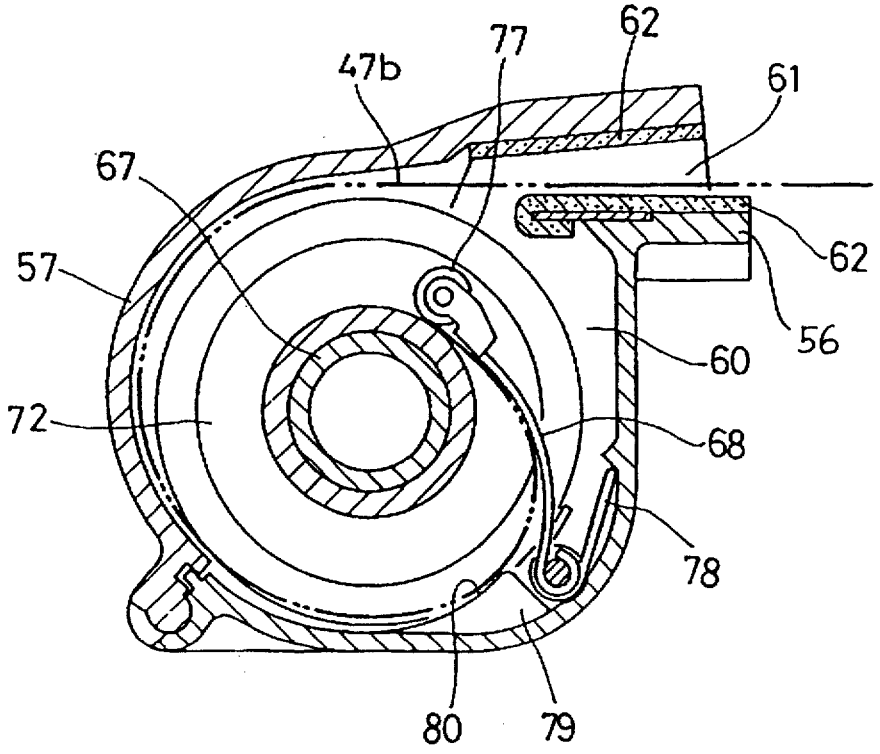
FIG. 16 is a section view showing the cartridge under a second condition.
Figure 17:
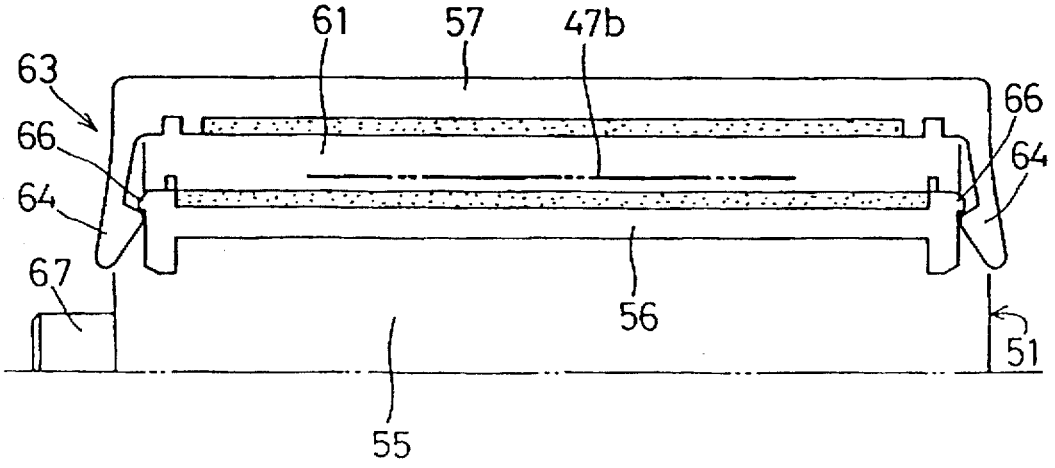
FIG. 17 is a view showing the film entrance/exit opening of FIG. 16, FIGS. 18*a* and 18*b* are a first operation-descriptive view of the handling apparatus.

As shown in FIG. 17, the engaging pawls 64 are engageable also with engaging portions 66 provided at opposed upper side ends of the guide plate 56. When the engaging pawls 64 and the engaging portions 66 are engaged with each other, the cover 57 is retained at a half-opened state, as shown in FIG. 16. In this state shown in FIG. 16, the film entrance/exit opening 61 has an opening area greater than that of the opening 61 in the state shown in FIG. 15.

Within a film storing space 60 defined inside the cartridge 51, there are incorporated a spool 67 and a guiding plate 68 for guiding the film 47*b* inserted into the film storing space 60 from the film entrance/exit opening 61 on to the outer periphery of the spool 67.

Figure 11:
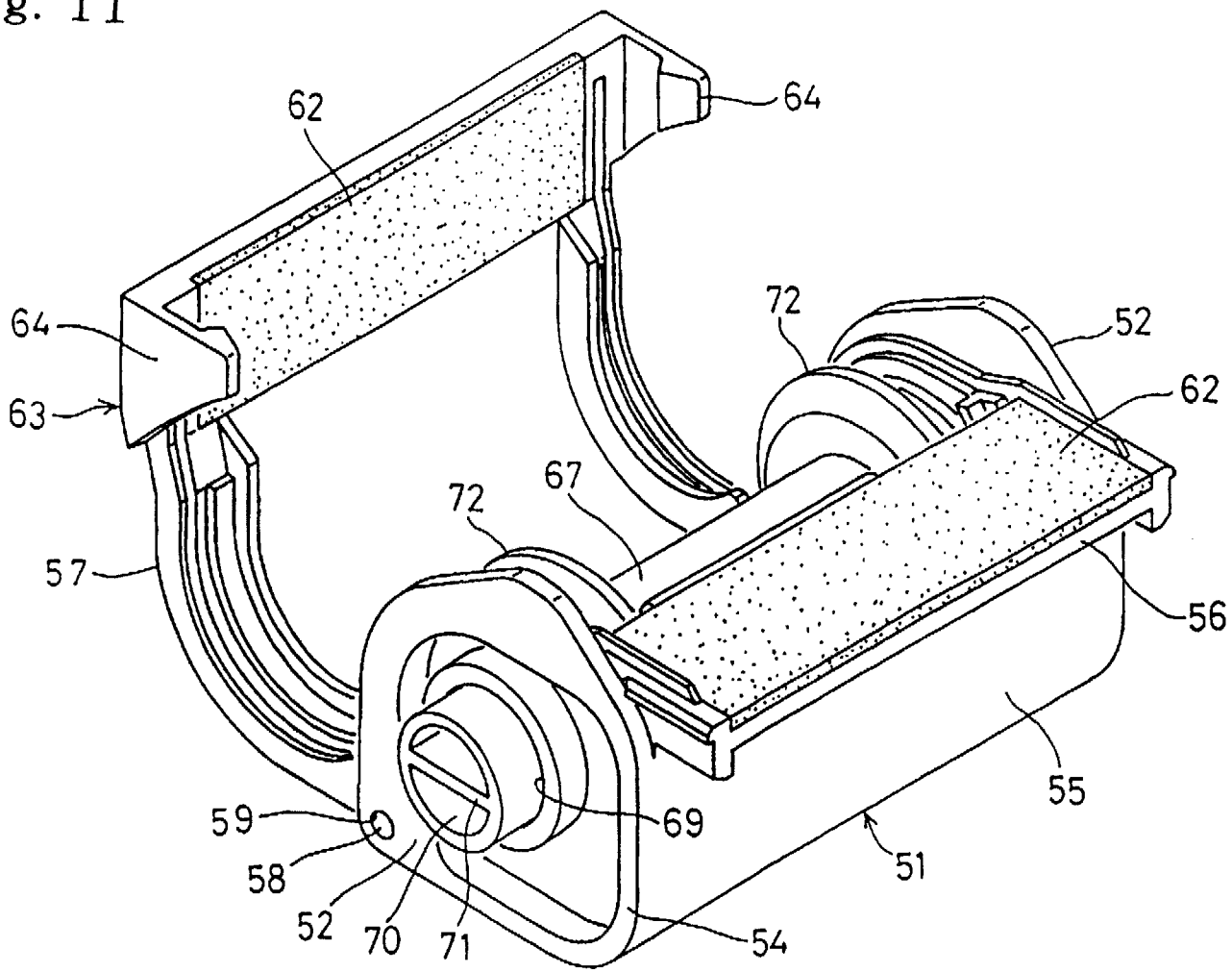
FIG. 11 is a perspective view of a film cartridge.
Figure 12:
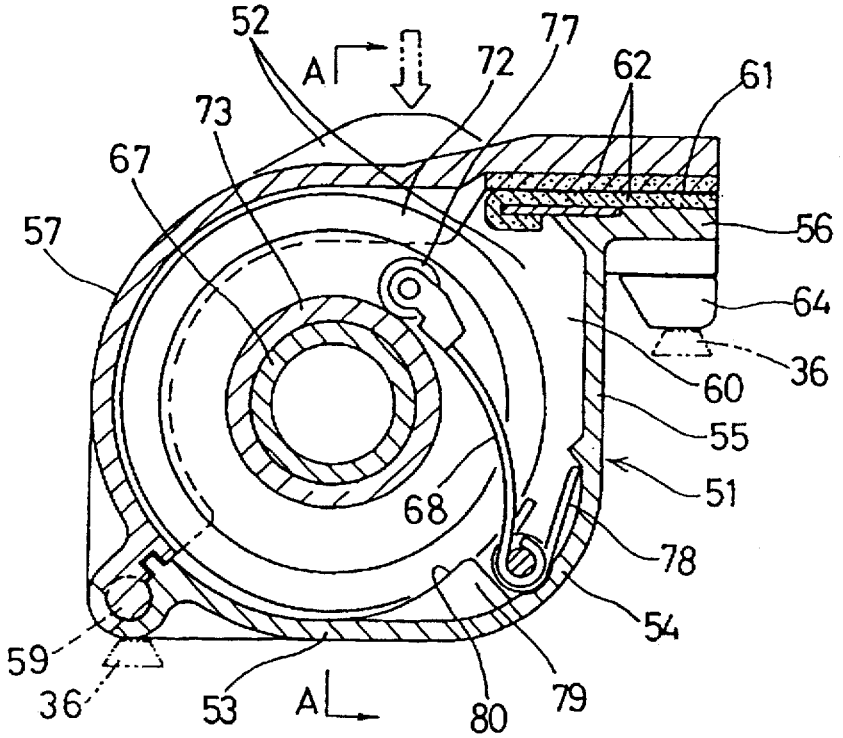
FIG. 12 is a section view showing the cartridge under a first condition.

As shown in FIG. 11, the spool 67 is inserted and rotatably supported at insertion holes 69 defined in the respective side plates 52, with one terminal end of the spool extending through one insertion hole 69 to be exposed to the outside. Further, the spool 67 defines holes 70 at opposed side faces thereof, and torque transmitting elements 71 are fitted within the holes 70.

The spool 67 also includes a pair of opposed flanges 72 disposed inside the film storing space 60 with a spacing therebetween which is greater than the width of the film to be rolled on the spool. On each flange 72 on the outer side of the spool 67, there is fitted a sleeve 73 formed of elastic material, e.g. rubber, having anti-slippage property for the film. The flange 72 defines, along the outer periphery thereof, an annular groove 74, which may be engaged with a ridge 75 formed on each of the opposed inner sides of the cover 57. By the engagement between the ridges 75 and the annular grooves 74, the cover 57 and the flanges 72 are fitted to each other in a light shielding manner.

Figure 14:
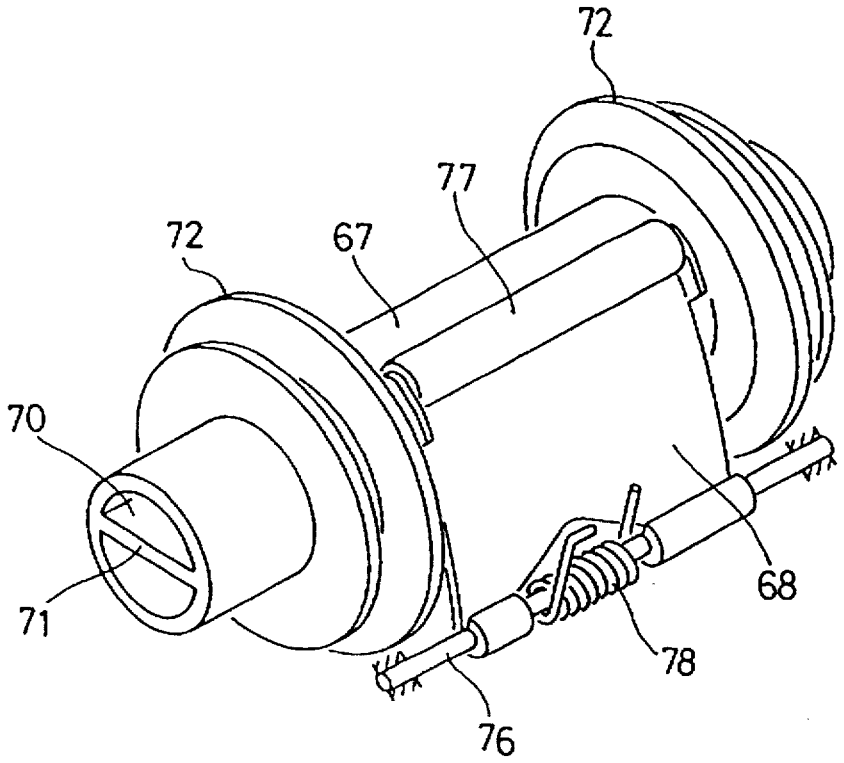
FIG. 14 is a perspective view showing principal portions of the cartridge.

As shown in FIG. 14, the guiding plate 68 is pivotably mounted on a shaft 76 disposed at the bottom of the film storing space 60. And, a roller 77 is attached to the leading edge of the guide plate 68 facing the outer periphery of the spool 67.

Further, the guiding plate 68 is urged by a spring 78 fitted on the shaft 76 toward the spool 67 so as to press the roller 77 against the outer periphery of the spool 67.

Figure 13:
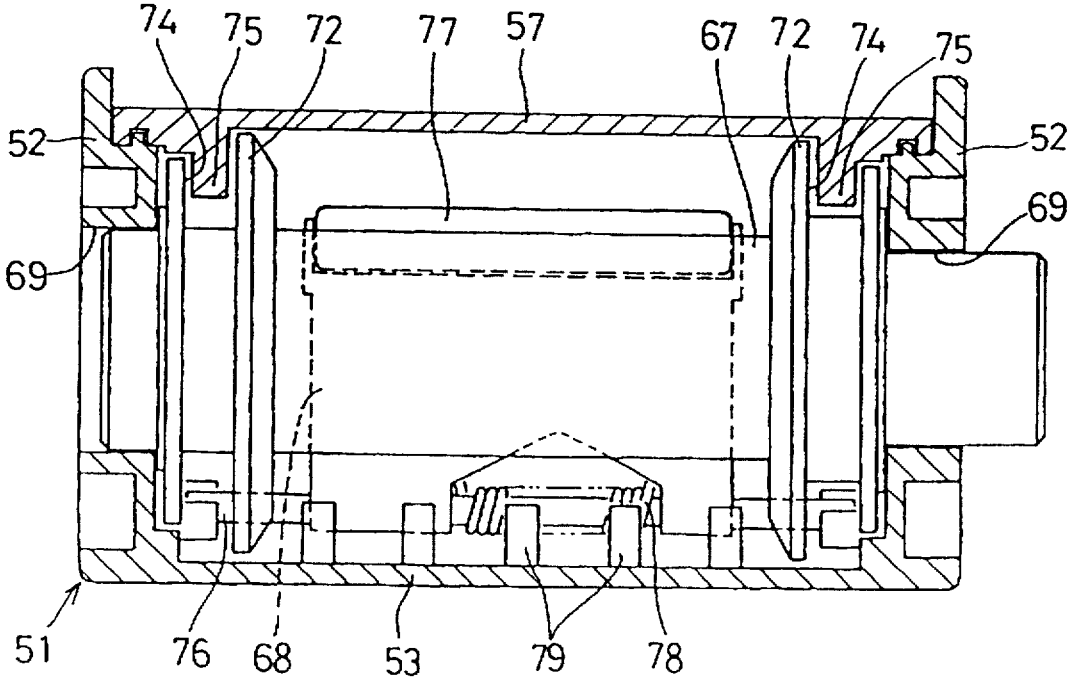
FIG. 13 is a section view taken along a line A—A in FIG. 12.

As shown in FIG. 13, at the front side of the guiding plate 68, there are provided a plurality of guide elements 79, each of which forms an arcuate guiding edge 80 for guiding the film **47*b* to the guiding plate 68**.

Then, with the above-described construction of the cartridge 51, for replacing the film **47*b* by another film, the film 47*b* wound about a spool inside a film container is unwound therefrom by rotation of the spool and the leading end of this film 47*b* is inserted through the film entrance/exit opening 61 of the cartridge 51 into the film storing space 60. In this condition where the leading end of the film is nipped between the contacting portions of the spool 67 and the roller 77, the rotation of the spool of the film container is stopped, and instead the spool 67 of the cartridge 51** is rotated in a film winding direction.

During the above-described insertion of the leading end of the film **47*b* into the film entrance/exit opening 61, the cover 57 is maintained under the half-opened state by engaging the engaging pawls 64 with the engaging portions 66, as shown in FIG. 16**.

For bringing the cover 57 into the half-opened state described above, as denoted by chain lines in FIG. 12, while the leading ends of the engaging pawls 64 and the connecting portion between the cover 57 and a cartridge body **51*a* are supported on a receiver element 36, the upper faces of the side plates 52** are pressed down as denoted by the arrow.

In the above-described condition, as shown in FIG. 16, when the leading end of the film **47*b* is inserted through the half-opened film entrance/exit opening 61 into the film storing space 60, the film 47*b* is guided by the guiding plate 68 to the region where the spool 67 and the roller 77 are in contact with each other. Then, when the leading end of the film 47*b* is inserted into the nip, i.e. the contacting portions of the spool 67 and the roller 77, the spool 67 is rotated in the film winding direction, so that the film 47*b* is wound about the outer periphery of the spool 67**.

Then, when the trailing end of the film **47*b* comes to be exposed outside the film container, the film 47*b* is cut off the film container, and the cover 57 is closed so as to bring the pawls 64 into engagement with the opposed lower sides of the guide plate 56**.

Incidentally, for developing the film **47*b* stored in a rolled state within the cartridge 51, the engaging pawls 64 are brought into engagement with the engaging portions 66 to retain the cover 57 at the half-opened state, under which state the film 47*b*** is withdrawn from the cartridge.

The film feeding device 41 handles the films **47*a*, 47*b* stored in the cartridge 51 having the above-described construction and the patrone 50**, in a manner to be described next.

Figure 9:
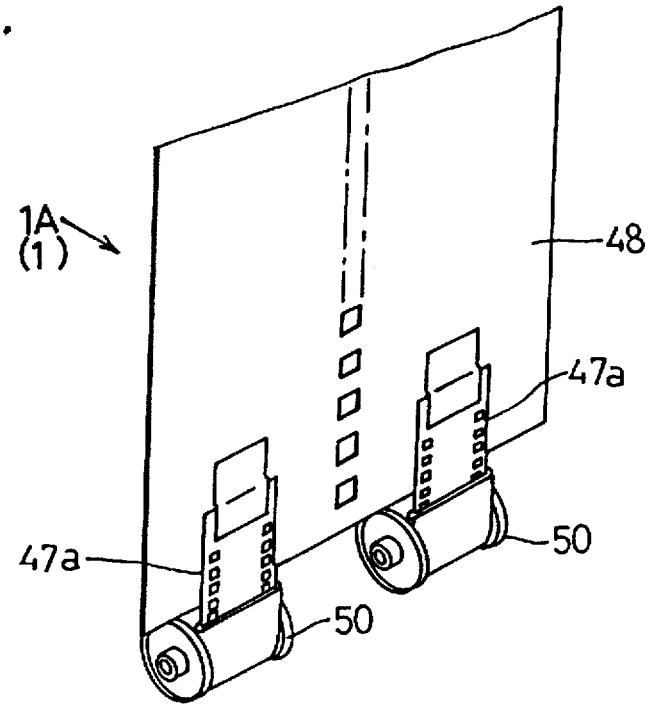
FIG. 9 is a perspective view of a film connecting member.
Figure 10:
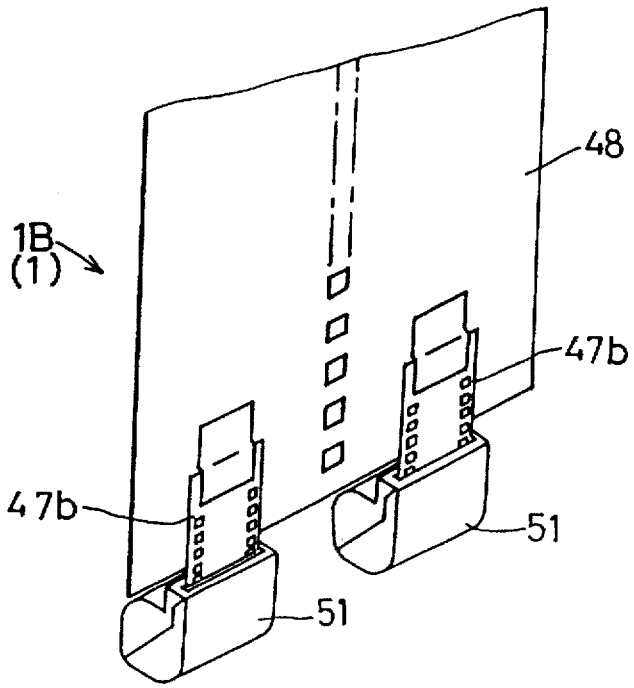
FIG. 10 is a perspective view of a further film connecting member.

As shown in FIGS. 9 and 10, a film splicing assembly 1A, 1B is formed by connecting the leading ends of two rolls of films withdrawn from two patrones 50 or cartridges 51 as one group to a single leader 48. Then, a plurality of these film splicing assemblies 1A, 1B are loaded in the film loading section 42.

In the case of the film **47*b* stored in a rolled state in the cartridge 51 as the reusable type film container, after this film 47*b* withdrawn from the cartridge 51 is subjected to such operations as developing and printing operations, this film is again wound back into the cartridge 51** for re-use.

Incidentally, in the present embodiment, the films from two patrones 50 or cartridges 51 are connected as one unit group to the single leader 48. Yet, it is also conceivable to connect the film from only one patrone or cartridge to the leader.

The film loading section 42 includes a loading opening 2 into which the film splicing assemblies 1A, 1B are set with the leaders 48 thereof being oriented upward, a downward transporting device 3 for downwardly feeding the set film splicing assemblies 1A, 1B inside this film loading section 42, a lateral transporting device 4 for laterally transporting the film splicing assemblies 1A, 1B fed by the downward transporting device 3 inside the film loading section 42, and an upper transporting device 5 for upwardly transporting the film splicing assemblies 1A, 1B which have been transported laterally by the lateral transporting device 4, one after another from the side of the leader 48 thereof to the film feeding section 43.

Referring to the lateral transporting device 4, a pair of bar conveyers 6 each defining an elongate slot are disposed at opposed sides within the film loading section 42. And, a plurality of pairs of these bar conveyers 6 are equi-distantly mounted on a conveyer chain. In operation, while the film splicing assembly 1A, 1B set at the loading opening 2 is being downwardly fed by the downward transporting device 3, opposed side ends of its leader 48 are inserted and engaged into the elongate slots of opposed guide bars 7, whereby the film splicing assembly 1A, 1B is vertically supported by the guide bars 7 with its leader 48 being oriented upwards. Under this condition, the lateral transporting device 4 laterally transports the assembly to the upward transporting device 5 by turning of the bar conveyers 6 about a vertical axis.

Inside a case 9 having a vertically openable lid 8, the film feeding section 43 includes a splicing assembly passage 10 in which the film splicing assembly 1A, 1B fed by the upward transporting device 5 is caused to pass with the leader 48 thereof being at the forward end, a slit-like film passage 11 in which the leader 48 together with the films **47*a*, 47*b* is caused to pass toward the developing section 40, a holder 12 having a holding portion 12*a* for holding the patrone 50 or cartridge 51 by holding it with a concave face portion, a cutter device 13 for cutting the rear end of the film 47*a* when this film 47*a* stored within the patrone 50 is to be fed to the developing section 40, a pinch transporting device 14 for pinching the leader 48 and the films 47*a*, 47*b* having passed through the splicing assembly passage 10 into the film passage 11 and transporting these toward the developing section 40, and a shutter device 15 capable of selectively opening and closing an entrance opening to the splicing assembly passage 10**.

The splicing assembly passage 10 includes a slit-like leader passage 10A through which the leader 48 passes and a container passage 10B through which the patrone 50 or cartridge 51 storing the film **47*a* or 47*b* passes. And, the leader passage 10A is continuously communicated with the film passage 11. Within this film passage 11, there are provided a passage-detecting sensor 33 using a limit switch or the like for detecting passage or non-passage of the leading end of the leader 48 and a film-width detecting photosensor 35 for distinguishing between the wide film 47*a* which was stored in the patrone 50 or the narrow film 47*b* which was stored in the cartridge 51**.

The holding portion 12*a* of the holder 12 is pivotable about a horizontal axis X1 along the container passage 10B, and a coil spring 16 is provided for urging the holding portion 12*a* to the upstream side of the container passage 10B.

Figure 4:
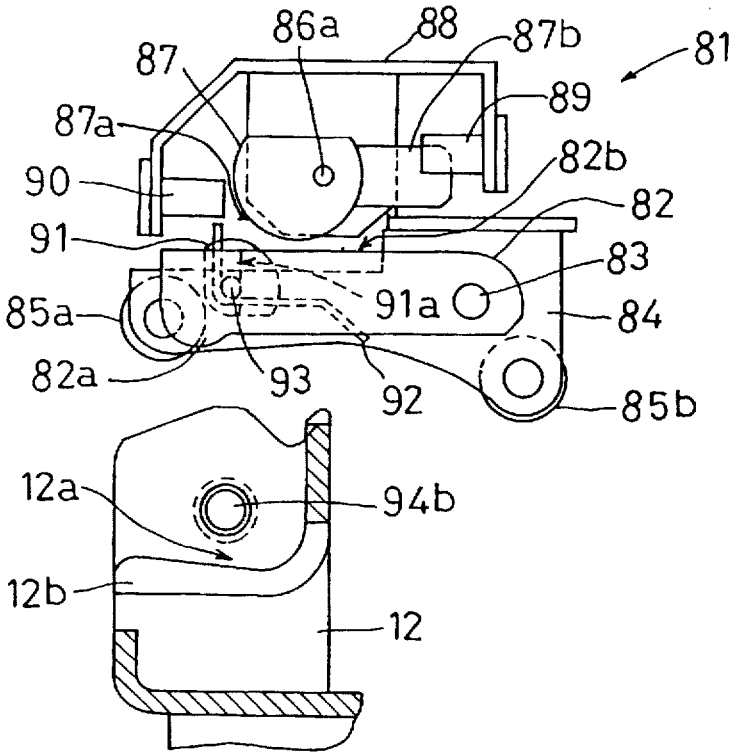
FIG. 4 is a side view of a film container handling apparatus relating to the invention.
Figure 5:
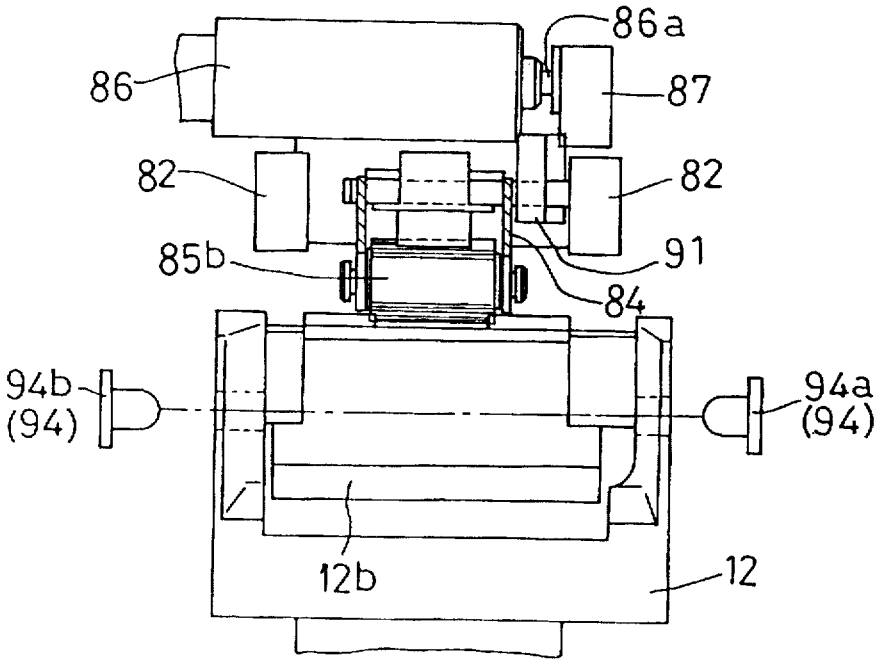
FIG. 5 is a front view of the film container handling apparatus.

Further, as shown in FIGS. 4 and 5, of the holding portion 12*a* of the holder 12, a receiving portion 12*b* thereof for receiving the cartridge 51 or patrone 50 is elastically deformable. Further, at the holding portion 12*a*, a detecting sensor 94 is disposed in the direction of the axis of the patrone 50 or cartridge 51. This detecting sensor 94 is an optical sensor including a beam emitter 94*a* and a beam receiver 94*b* disposed in opposition to each other. The holder 12 defines through holes where the beam emitter 94*a* and the beam receiver 94*b* oppose to each other. This detecting sensor 94 functions as detecting means for detecting the film container being held at the holding portion 12*a*.

A cartridge handling apparatus 81 of the invention is shown in details in FIGS. 4 and 5.

A pair of opening levers 82, 82 as 'a first cam follower', are interconnected via a connecting shaft 83 to be pivotable about this shaft 83. Each opening lever 82 includes a pressing portion 82*a* for pressing the side plate 52 of the cartridge 51 when this cartridge 51 is held at the holding portion 12*a*. Hence, this pair of opening levers 82, 82 are disposed in opposition to the pair of side plates 52, 52 of the cartridge 51. Each opening lever 82 includes also a contact portion 82*b* at a portion thereof opposite to the pressing portion 82*a*. And, the lever 82 is urged clockwise about the connecting shaft 83 by means of an unillustrated spring and the lever is normally set at an initial condition shown in FIG. 4.

A second cam follower 91 is provided to be pivotable about a support shaft 93. This second cam follower 91 includes a contact face 91*a* having a substantially planar shape. Further, the second cam follower 91 integrally includes a discharging plate 92 for discharging the cartridge 51 from the holding portion 12*a*. The second cam follower 91 is pivotally urged counter-clockwise about the support shaft 93 by means of an unillustrated spring and is normally set at an initial condition shown in FIG. 4. A rotary cam 87 is mounted on a drive rotary shaft 86*a* attached to a motor 86 to be driven to rotate by this motor 86. The rotary cam 87 integrally includes a first drive cam 87*a* and a second drive cam 87*b*.

The first drive cam 87*a* has a shape like a circular disc with a portion thereof cutaway along a straight line. And, the center of this disc is offset from the axis of the drive rotary shaft 86*a*, so that this first drive cam 87*a* is constructed as an eccentric cam. In operation, the first drive cam 87*a* drives the opening levers 82 by coming into contact with the respective contact portions 82*b* of the levers 82.

The second drive cam 87*b* has a shape projecting in the form of a rectangle from the axis of the drive rotary shaft 86*a*. In operation, this second drive cam 87*b* drives the second cam follower 91 and the discharging plate 92 by coming into contact with the contact face 91*a* of the second cam follower 91.

The first drive cam 87*a* and the opening levers 82 together constitute opening means for switching over the film entrance/exit openinng 61 from a first condition to a second condition when the film container is held at the holding portion.

The second drive cam 87*b*, the second cam follower 91 and the discharging plate 92 together constitute discharging means for discharging the film container from the holding portion 12*a* after the film is withdrawn from the film container under the second condition.

A mounting plate 88 is provided for mounting a first sensor 89 and a second sensor 90. These sensors 89, 90 are optical sensors. Through detection of passage of the second drive cam 87*b* through the positions of these first and second sensors 89, 90, the driving position of the rotary cam 87 may be controlled. That is to say, the second drive cam 87*b* functions not only for driving the discharging plate 92, but also for enabling the driving control of the rotary cam 87 in cooperation with the first and second sensors 89, 90.

A roller mounting plate 84 rotatably mounts two rollers 85*a*, 85*b*, which are provided for preventing frictional damage to the film.

As shown in FIG. 3, the pinch transporting device 14 includes two roller pairs 17 each pair including a drive roller 17A about which the films 47*a*, 47*b* or its leader 48 is entrained in an arcuate form, and two free rollers 17B, 17C for pinching the films 47*a*, 47*b* or its leader 48 entrained about the drive roller 17A in cooperation with the drive roller 17A at two separate positions along an entraining passage 18, with the two roller pairs 17 being disposed side by side in the direction of the width of the film passage 11 in the moving path of the two rolls of films 47*a*, 47*b* fed from the patrones 50 or cartridges 51.

Further, a solenoid device 20 is provided for switching over the roller pairs 17 between a pinching state and a pinching released state by moving a frame 19 mounting the free rollers 17B, 17C thereon to and away from the drive rollers 17A.

In operation, when the leading end of the leader 48 of the film splicing assembly 1A, 1B fed by the upward transporting device 5 is caused to pass through the splicing assembly passage 10 into the film passage 11 and then this is further moved to pass between the drive rollers 17A and the free rollers 17B, 17C which are set ready under the pinching released state, this passage is detected by the passage-detecting sensor 33. Upon this detection, the roller pairs 17 are switched over to the pinching state to pinch the leader 48 and also the drive rollers 17A are driven to feed the leader 48 toward the developing section 40.

Next, the operations of the handling apparatus 81 relating to the invention will be described with reference to FIGS. 18 and 19.

The functions of the apparatus partially differ from each other for the patrone 50 and the cartridge 51. Thus, the functions for the cartridge 51 will be described first.

With the feeding of the leader 48 by the drive rollers 17A toward the developing section 40, the cartridges 51 are pulled and moved along the container passage 10B. Then, this movement is checked when these cartridges 51 come to be held by the holding portion 12*a* of the holder 12. In the course of this, the detecting sensor 94 detects arrival of the cartridges 51 at the holding portion 12*a*. Based on a detection signal from this detecting sensor 94, a start signal is outputted to the motor 86. Also, the pinch transport device 14 is stepped temporarily. In response to the start signal described above, the motor 86 is driven to rotate the drive rotary shaft 86*a* connected to this motor 86 together with the rotary cam 87 mounted thereon in the counter-clockwise direction shown in FIG. 18(*a*).

Then, each first drive cam 87*a* formed on the rotary cam 87 comes into contact with the contact portion 82*b* of the opening lever 82, so as to pivot the opening lever 82 counter-clockwise. With this, as shown in FIG. 18(*b*), the pressing portion 82*a* of the opening lever 82 presses the side plates 52 of the cartridge 51, thereby to render the film entrance/exit opening 61 into the half-opened state. In the course of the above, the opening lever 82 applies a load to the cartridge 51. Yet, the receiving portion 12b, which is provided on the opposite side to the portion applied with the load, of the holding portion 12a is formed elastically deformable, so that the receiving portion 12b may be elastically deformed as indicated by an arrow in FIG. 18(*b*). Consequently, the cartridge may be protected against application of excessive load.

Figure 18A:
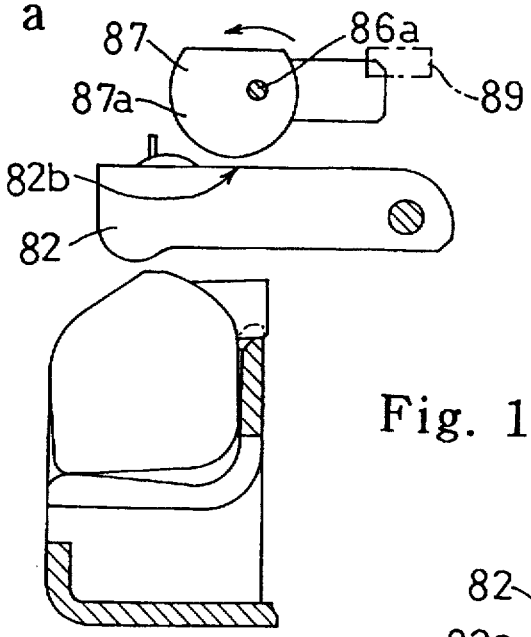
Figure 18B:
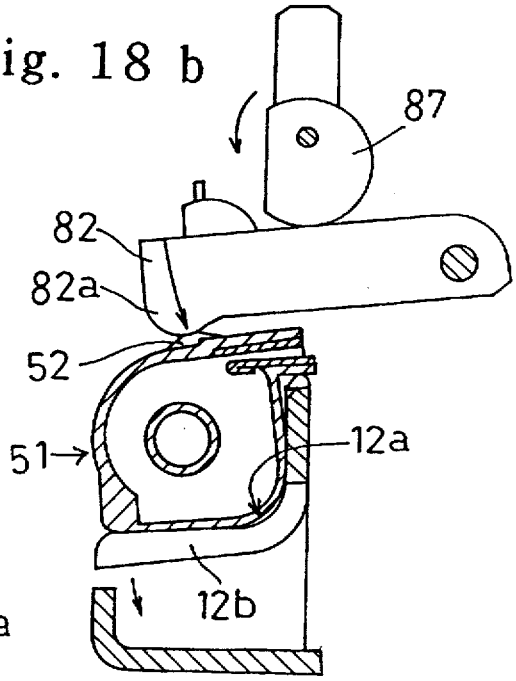
Figure 18C:
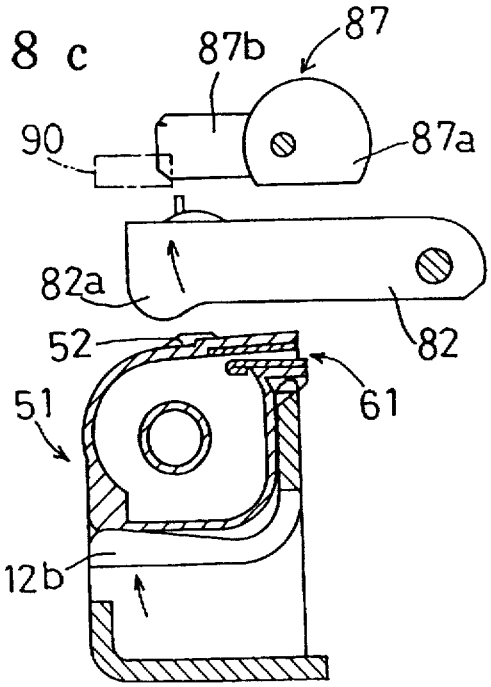

Incidentally, in FIG. 18(*b*), the rotary cam 87 has moved from its initial position of FIG. 18(*a*) to a 90-degree rotated second position. In this state, the rotary cam 87 provides the maximum cam lift amount and the opening lever 82 also provides the maximum amount of pivotal movement.

Thereafter, the first cam 87a continues to pivot and reaches a further position shown in FIG. 18(*c*). Then, the second sensor 90 detects arrival of the second drive cam 87b, and based on a signal indicative of this arrival, the motor 86 is stopped. In this state, the rotary cam 87 has been rotated to a third position 180 degree rotated from its initial position. Also, the opening lever 82 is returned to the initial position by an urging force of an unillustrated spring. Further, as indicated by an arrow in FIG. 18(*c*), the elastically deformed receiving portion 12b elastically resiles to its original shape. Incidentally, after the cartridge 51 is rendered into the half-opened state, the cartridge maintains this state. Accordingly, the half-opened state is maintained after the pressing portion 82a departs from the side plate 52.

In the state of FIG. 18(*c*) while the motor 86 is stopped, the films 47b stored in the wound state within the cartridges 51 are respectively withdrawn therefrom. This withdrawing operation of the film 47b is effected by the pinch transport device 14. And, this withdrawing operation of the film 47b may be effected smoothly since the film entrance/exit opening 61 is maintained under the half-opened state.

When the film-width detecting photosensor 35 detects the trailing end of the film 47b in the withdrawing direction thereof, a start signal is again outputted to the motor 86. With this, as shown in FIG. 19(*a*), the rotary cam 87 begins to rotate counter-clockwise again. Then, as illustrated in FIG. 19(*b*), the leading end of the second drive cam 87b comes into contact with the contact face 91a of the second cam follower 91, thereby to rotate this follower clockwise. And, the discharging plate 92 rotatable in unison with the second cam follower 91 is also rotated clockwise, so that the leading end of the discharging plate 92 pushes out the film entrance/exit opening 61 of the cartridge 51, so that the cartridge 51 is discharged from the holding portion 12a into the recovering section 45 to be detailed later.

Figure 19A:
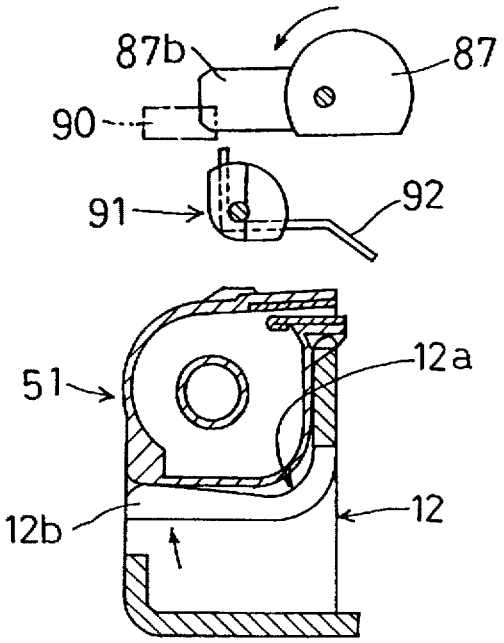
FIGS. 19*a* and 19*b* are a second operation-descriptive view of the handling apparatus.
Figure 19B:
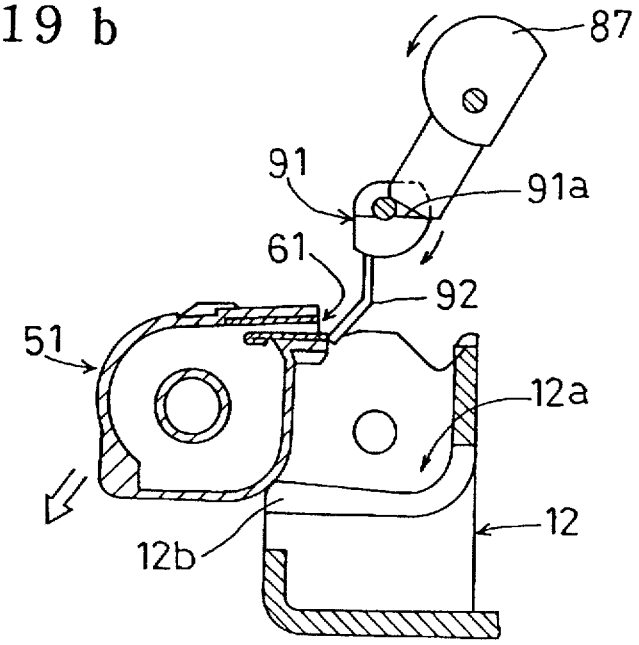

Thereafter, the rotary cam 87 continues the counter-clockwise rotation and returns from the state of FIG. 19(*b*) to the initial state of FIG. 18(*a*); then, the first sensor 89 detects the arrival of the second drive cam 87b. Based on a detection signal indicative of this arrival, the motor 86 is stopped again.

Next, the handling operations of handling apparatus 81 in the case of patrones 50 will be described.

In association with the feeding of the leader 48 by the drive rollers 17A toward the developing section 40, the patrones 50 are pulled along the container passage 10B and this movement is checked when the patrones 50 come to be held by the holding portions 12a. Then, the detecting sensor 94 detects the arrival of the patrones 50 at the holding portions 12a. Based on the detection signal from the detecting sensor 94, a start signal is outputted to the motor 86. Subsequent operations of the handling apparatus 81 are identical to those illustrated in FIGS. 18, 19. In this case, the patrones 50 too will be pushed by the opening lever 82. Yet, since the patrone 50 has a height shorter than that of the cartridge 51 and the afore-described elastic deformation occurs in the receiving portions 12b of the holder 12 when the opening levers 82 are operated. Accordingly, there occur no problems in these handling operations.

Thereafter, the films 47a wound and stored within these patrones 50 are withdrawn therefrom. In this case of the patrones 50 being held by the holder 12, the trailing ends of the films 47a are fixed to the patrones 50, so that with completion of the withdrawal of the films 47a from the patrones 50, the holder 12 is pivoted against the urging force of the coil spring 16 until this holder 12 come into abutment against the stopper 21 towards the terminal end of the container passage 10B. Then, as the holder 12 turns ON the photo sensor 34, the cutter device 13 is activated to cut off the rear ends of the films 47a, whereby the patrones 50 and the films 47a are separated from each other, and the films 47a are fed further toward the developing section 40.

On the other hand, in the case of the cartridge 51, the rear or trailing end of its film 47b is not fixed to the cartridge 51. That is, the film 47b may be smoothly separated from the cartridge 51. And, the holder 12 does not effect the pivotal movement described above. Accordingly, the holder 12 does not turn ON the photosensor 34, and the trailing end of the film 47b is just moved out of the cartridge 51 to be separated therefrom and this separated film is fed to the developing section 40.

The patrones 50 or cartridges 51 after completion of withdrawal of the films 47a, 47b therefrom will be dropped off the holder 12 to be recovered into the recovering section 45.

As described above, in the case of feeding the films 47a stored in the patrones 50 toward the developing section 40, the holder 12, the pinch transport device 14 and the cutter device 13 together constitute the separating section 44 for withdrawing the films 47a from the patrones 50 and then separating the films from the patrones 50. On the other hand, in the case of feeding the films 47b stored in the cartridges 51 toward the developing section 40, the holder 12, the handling apparatus 81 and the pinch transport device 14 together constitute the separating section 44 for withdrawing the films 47b from the cartridges 51 and separating the films from the cartridges.

Figure 6:
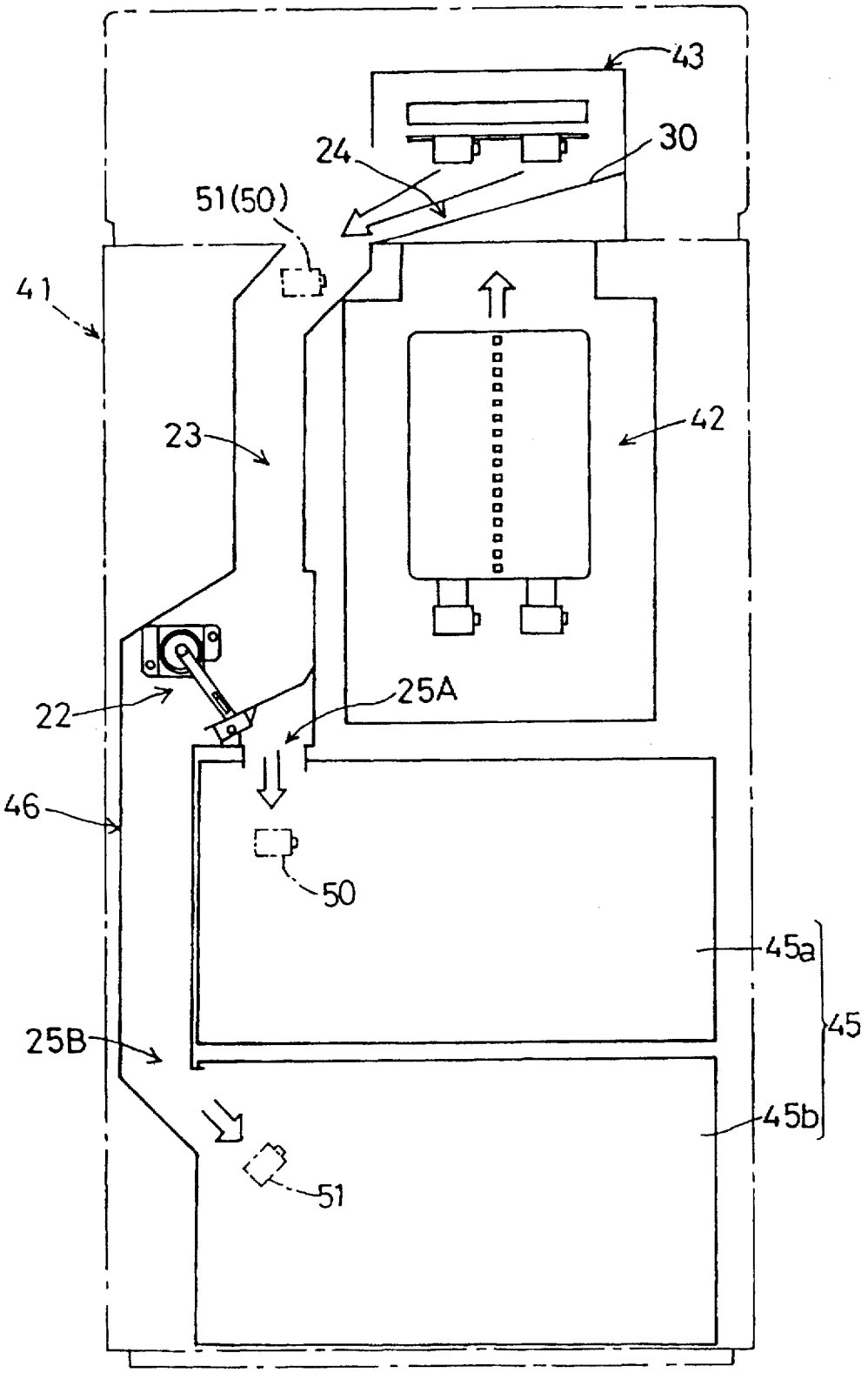
FIG. 6 is a schematic side view of a film recovering section.
Figure 8:
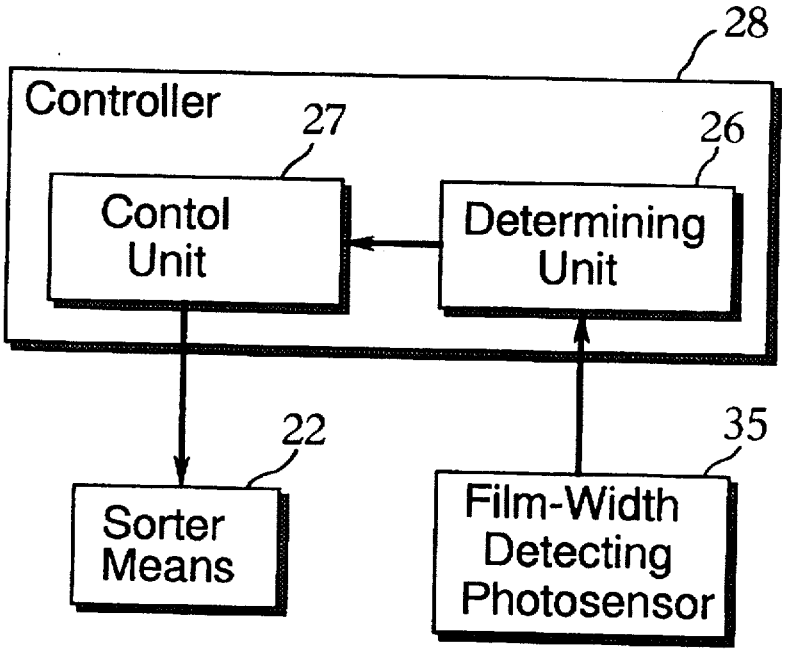
FIG. 8 is a block diagram of a control construction.

The recovering section 46, as shown in FIG. 6, includes a sorter device 22 for sorting between the patrones 50 and the cartridges 51, a common chute passage 23 for chuting the patrons 50 and cartridges 51 separated at the separating section 4, a guiding section 24 for guiding the patrones 50 and cartridges 51 separated at the separating section 44 and chuted therefrom toward an entrance opening of the common chute passage 23, a pair of collecting sections 45a, 45b disposed one above the other for separately collecting therein the patrones 50 and the cartridges 51 sorted by the sorter device 22, and collecting chute passages 25A, 25B for separately chuting the patrones 50 and cartridges 41 sorted by the sorter device 22. Further, as shown in FIG. 8, the recovering section 45 includes also a controller 28 having a determining unit 26 for determining the type of the film containers, based on the result of detection by the film-width detecting photosensor 35, i.e. determining whether the container are patrones 50 or cartridges 51 and a control unit 27 for operating the sorter 22 based on determination information from the determining unit 26.

The guiding section 24 includes a discharging guide plate 29 for receiving the patrones 50 or cartridges 51 chuted from the holder 12 to the outside of the container passage 10B and a chute 30 for chuting the patrones 50 and cartridges 51 discharged by the discharging plate 29 toward the entrance opening of the common chute passage 23. The discharging guide plate 29 is normally retracted toward the chute 30 by means of an unillustrated spring. Then, when the shutter of the shutter device 15 is closed, the plate 29 is pressed by this shutter, so that the discharging plate 29 is caused to project into the container passage 10B. This construction eliminates the possibility of the film **47*a*, 47*b* being inadvertently withdrawn from the patrone 50 or cartridge 51 when the patrone 50 or cartridge 51 passing through the passage 10B accidentally engages with the discharging guide plate 29**.

Conversely and as an alternative construction for this discharging guide plate 29, this plate 29 may be pivotally urged into the container passage 10B. In this case, when the discharging guide plate 29 is pressed from under by the patrone 50 or cartridge 51 on its way to the holder 12, the plate 29 is retracted toward the chute 30 against the urging force, so as to allow the movement of the patrone 50 or cartridge 51 toward the holder 12.

Then, after the passage of the patrone 50 or cartridge 51, the guide plate 29 projects into the container passage 10B, so as to discharge the patrone 50 or cartridge 51, which was separated at the separating section 44 and dropped therefrom, toward the chute 30.

Figure 7:
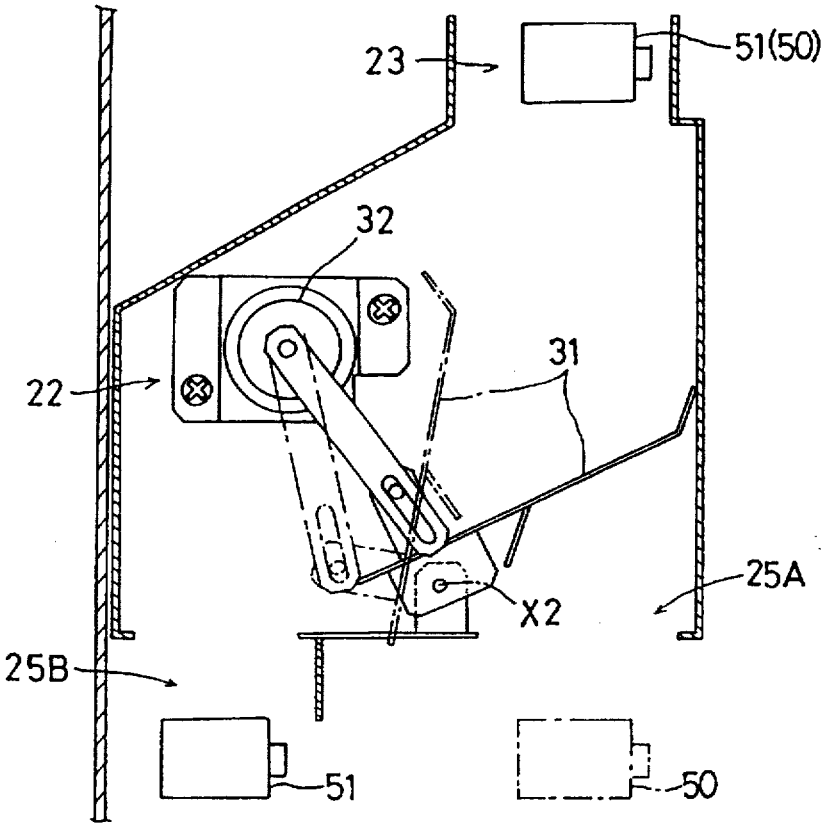
FIG. 7 is an enlarged side view of a sorter device.

The sorter device 22, as shown in FIG. 7, includes an opening/closing guide plate 31 disposed between a first collecting chute passage 25A extending to the first collecting section **45*a* for collecting the patrones 50 and a second collecting chute passage 25B extending to the second collecting section 45*b* for collecting the cartridges 51. This opening/closing guide plate 31 is switchable between a first pivotal posture for opening the entrance opening of the first collecting chute passage 25A and closing the entrance opening of the second collecting chute passage 25B and a second pivotal posture for closing the entrance opening of the first collecting chute passage 25A and opening the entrance opening of the second collecting chute passage 25B. Further, a rotary solenoid 32 is provided for pivoting the opening/closing guide plate 31 about a horizontal axis X2 between the first pivotal posture and the second pivotal posture. In operation, the sorter device 22 is capable of switching over the chute path of the separated patrone 50 and cartridge 51 extending from the separating section 44 to the first and second collecting sections 45*a*, 45*b***.

Then, based on the determination information from the determining unit 26, in case the patrone 50 is separated and chuted, the control unit 27 pivots the opening/closing guide plate 31 to the first posture to collect this patrone into the first collecting section **45*a*. Conversely, when the cartridge 51 is separated and chuted, the control unit 27 pivots the opening/closing guide plate 31 to the second pivotal posture to collect this cartridge into the second collecting section 45*b***.

Further embodiments of the present invention will be specifically described next.

(1) In the foregoing embodiments, the handling apparatus 81 of the invention is employed for feeding the films **47*a*, 47*b* to the developing section 40**. The apparatus may alternatively used e.g. for printing and exposing operation to a print paper or reading image information of the film.

(2) In the foregoing embodiments, the handling apparatus 81 is operated also when the film **47*b* is withdrawn from the patrone 50. Instead, with detection of the type of the film container, in case the detected container is a patrone 50, the handling apparatus may remain un-operated. In this case, it is conceivable, for example, to incorporate the film-width detecting sensor within the film passage 11 extending to the holding portion 12*a***. Further alternatively, there may be used a magnetism detecting sensor having a magnet by utilizing the fact that the film container is formed of either magnetic material or non-magnetic material.

(3) Likewise, the determining unit and the sorter device too may be adapted to make the determination or sorting by distinguishing between the magnetic film container and non-magnetic film container by means of a magnet. Further, the unit and device may be adapted to read a bar code provided on the film container.

(4) In the foregoing embodiments, the rotary cam 87 is mounted directly on the drive rotary shaft **86*a* of the motor 86. Instead, the rotary cam 87 may be mounted indirectly via a reduction device. In the foregoing embodiments, the opening levers 82 as the first cam follower presse the side plates 52 of the cartridge 51. Instead, it is also conceivable to adapt the rotary cam 87** to directly act on the side plates.

The first drive cam **87*a* and the second drive cam 87*b* may be formed as one integral member or formed as two separate elements. Further, the discharging operation of the cartridge 51 from the holding portion 12*a* may be effected directly by the rotary cam 87**.

The invention may be embodied in other specific forms without departing from the spirit or essential characteristics thereof. The present embodiments are therefore to be considered in all respects as illustrative and not restrictive, the scope of the invention being indicated by the appended claims rather than the foregoing description and all changes which come within the meaning and range of equivalency of the claims are therefore intended to be embraced therein.

What is claimed is:

1. A film container handling apparatus for handling a film container including a film entrance/exit opening which is selectable between a first condition providing an opening and a second condition providing a larger opening, the apparatus comprising:

a holding portion for holding the film container;

opening means for switching over the film entrance/exit opening of the film container as held at the holding portion from the first condition to the second condition; and discharging means for discharging the film container from the film holding portion after the film has been removed from the film container under the second condition.

2. A film container handling apparatus as defined in claim 1, further comprising detecting means for detecting holding of the film container at the holding portion, and the opening means is activated in response to an output signal from the detecting means.

3. A film container handling apparatus as defined in claim 1, wherein at least a portion of the holding portion is elastically deformable.

4. A film container handling apparatus as defined in claim 1, wherein the opening means includes a first drive cam and a first cam follower associated with the first drive cam for opening the film container.

5. A film container handling apparatus as defined in claim 4, wherein the discharging means includes a second drive cam and a second cam follower associated with the second drive cam for discharging the film container.

6. A film container handling apparatus as defined in claim 5, wherein the first drive cam and the second drive cam are rotary cams which are mounted on a single common drive rotary shaft.

7. A film container handling apparatus as defined in claim 6, wherein the drive rotary shaft is driven by a drive source of a film feeding device.

8. A film container handling apparatus as defined in claim 2, wherein the detecting means is an optical sensor.

9. A film container handling apparatus as defined in claim 3, wherein the opening means includes a first drive cam and a first cam follower associated with the first drive cam for opening the film container.

10. A film container handling apparatus as defined in claim 9, wherein the holding portion is elastically deformed when the film container is opened.

11. A film container handling apparatus as defined in claim 4, wherein said first cam follower is a pivotally mounted opening lever and includes a pressing portion for pressing the film container.

12. A film container handling apparatus as defined in claim 6, further comprising a sensor for controlling the drive position of the rotary cam.

13. A film container handling apparatus as defined in claim 7, wherein the film feeding device feeds the film withdrawn from the film container to a developing section.

* * * * *